US012371137B2

(12) United States Patent
Merle et al.

(10) Patent No.: US 12,371,137 B2
(45) Date of Patent: Jul. 29, 2025

(54) WIND PROPULSION UNIT AND VESSEL COMPRISING SUCH A UNIT

(71) Applicants: OCEANWINGS, Paris (FR); MARVIN SERIES, Vannes (FR)

(72) Inventors: Katia Merle, Vannes (FR); Erwan Conan, Vannes (FR); Nicolas Baral, Vannes (FR); Nicolas Sdez, Paris (FR); Ludovic Gerard, Marseilles (FR)

(73) Assignees: OCEANWINGS, Paris (FR); MARVIN SERIES, Vannes (FR)

( * ) Notice: Subject to any disclaimer, the term of this patent is extended or adjusted under 35 U.S.C. 154(b) by 0 days.

(21) Appl. No.: 18/722,777

(22) PCT Filed: Dec. 23, 2022

(86) PCT No.: PCT/IB2022/062736
§ 371 (c)(1),
(2) Date: Jun. 21, 2024

(87) PCT Pub. No.: WO2023/119245
PCT Pub. Date: Jun. 29, 2023

(65) Prior Publication Data

US 2025/0050986 A1 Feb. 13, 2025

(30) Foreign Application Priority Data

Dec. 23, 2021 (FR) ..... 2114467

(51) Int. Cl.
*B63H 9/061* (2020.01)
*B63B 15/00* (2006.01)

(52) U.S. Cl.
CPC ..... *B63H 9/061* (2020.02); *B63B 15/0083* (2013.01); *B63B 2015/005* (2013.01)

(58) Field of Classification Search
CPC ... B63H 9/00; B63H 9/04; B63H 9/06; B63H 9/061; B63H 9/08; B63B 2015/0016; B63B 2015/005
(Continued)

(56) References Cited

U.S. PATENT DOCUMENTS 6,189,472 B1 * 2/2001 Duncan ..... B63H 9/06 114/102.16
11,820,480 B2 * 11/2023 Smith ..... B63H 9/061
2021/0163112 A1 6/2021 Smith

FOREIGN PATENT DOCUMENTS

EP 3409574 A1 12/2018
EP 3424810 A1 1/2019
(Continued)

OTHER PUBLICATIONS

International Search Report and Written Opinion received for PCT Patent Application No. PCT/IB2022/062736, mailed on Mar. 29, 2023, 19 pages (9 pages of English Translation and 10 pages of Original Document).

*Primary Examiner* — Daniel V Venne
(74) *Attorney, Agent, or Firm* — WOMBLE BOND DICKINSON (US) LLP

(57) ABSTRACT

The invention relates to a vessel comprising a wind propulsion unit (100) that is elongate in a vertical direction when in the operating position comprising propulsive elements (111, 112) and a mast (121).
The invention relates to a tilt device comprising a base (210) that is rigidly attached to a proximal region of the mast (121) of a unit, which tilt device rotates on a horizontal main axis (A) on a support (220) attached to a deck of the vessel, a tilt control device (216, 217) causing the base to rotate relative to the support, which tilt control device comprises a first actuator (217) capable of generating a linear force in a horizontal direction and a redirection element (216) con-
(Continued)

necting the actuator to the base (210) in order to exert a force on the base in a first region (218) located at a distance from the main axis, and a locking device (300) for locking the base (210) to the support element (220), which locking device comprises a second actuator (310) that is capable of exerting, in a second region (215) of the base (218), a retaining force in the vertical direction.
The wind propulsion unit (100) can be moved, by virtue of the one or more first actuators (217), between an inactive position, wherein it extends along the deck of the vessel and an erect position, the locking device (300) being capable of contributing to holding the unit in its active position.

10 Claims, 3 Drawing Sheets

(58) Field of Classification Search
USPC ..... 114/89, 90, 91, 98, 99, 102.1, 102.29, 114/108
See application file for complete search history.

(56) References Cited

FOREIGN PATENT DOCUMENTS

| | | | |
|---|---|---|---|
| JP | 2019-108046 | A | 7/2019 |
| NL | 1042240 | | 7/2018 |
| WO | 2018/039705 | A1 | 3/2018 |
| WO | 2018/087649 | A1 | 5/2018 |
| WO | 2020/115717 | A1 | 6/2020 |

* cited by examiner

WIND PROPULSION UNIT AND VESSEL COMPRISING SUCH A UNIT

FIELD OF THE INVENTION

The present invention relates generally to wind propulsion of vessels, particularly propulsion assistance for merchant ships.

PRIOR ART

In particular, documents WO2018087649A1 and WO2020115717A1 describe a wind propulsion unit comprising a double sail mounted on a structure angularly controlled about a generally vertical axis according to conditions, the double sail comprising a front flap and a rear flap, a front mast and a rear mast connected by an element forming a boom and by an element forming a gaff, the front flap being traversed by the front mast and turning on an axis defined thereby, and the rear flap being traversed by the rear mast and turning on an axis defined thereby.

The structure is capable of turning on an axis of rotation coinciding with the axis of rotation of the front mast.

We are also familiar with rotor-based propulsion units (e.g., of the Flettner rotor or suction rotor type), which are starting to equip merchant marine ships.

Solutions are also known for retracting a wind propulsion unit by tilting it to a generally horizontal position, to limit its size and/or exposure to the wind.

Thus document WO2018039705A1 describes such a solution, and more particularly a vessel comprising a wind propulsion unit elongated in a generally vertical direction in the operating position and comprising one or more propulsive elements and a mast, and further comprising in association with the wind propulsion unit a tilt device comprising a base that is rigidly attached to a proximal region of the mast and rotatably mounted about a generally horizontal main axis on a support element fixed to a deck of the vessel, a tilt control device adapted to cause the base to rotate relative to the support element.

SUMMARY OF THE INVENTION

The aim of the present invention is to provide a simple, economical and reliable solution for reducing the size or exposure of a rigid-sail or other type of wind propulsion unit, while making the propulsion unit very robust when in the erected operating position.

For this purpose, a vessel is proposed comprising at least one wind propulsion unit that is elongate in a vertical direction when in the operating position comprising propulsive elements and a mast, characterized in that it comprises, in combination with at least one wind propulsion unit, a tilt device comprising a base that is rigidly attached to a proximal region of the mast, which tilt device rotates on a generally horizontal main axis on a support attached to a deck of the vessel, a tilt control device capable of causing the base to rotate relative to the support, which tilt control device comprises a first actuator capable of generating a linear force in a horizontal direction and a redirection element connecting said actuator to the base in order to exert a force on the base in a first region located at a distance from the main axis, and a locking device for locking the base to the support element, which locking device comprises a second actuator that is capable of exerting, in a second region of the base distant from the first region in a direction transverse to said main axis, a retaining force in the vertical direction, said wind propulsion unit being movable, by virtue of the one or more first actuators, between an inactive position, wherein it extends substantially parallel to the deck of the vessel and an active erect position, the locking device being capable of contributing to holding the unit in its active position.

The vessel optionally comprises the following additional features, taken individually or in any combination that a person skilled in the art will understand as being technically compatible with one another:

- the or each first actuator is oriented generally horizontally and is connected to said first region by a respective linkage articulated on a movable part of the actuator and on said first region of the base along two axes generally parallel to the main axis (A).
- the vessel comprises two first actuators and two redirection elements connected to the base at two first regions generally aligned in a direction parallel to the main axis.
- the rotary mounting of the base on the support element comprises, on the one hand, a rotary shaft whose axis coincides with said main axis, and, on the other hand, at least one arcuate groove whose center is located on said main axis, cooperating with a finger capable of moving in said groove during rotation.
- the or each second actuator comprises an cylinder fixed rigidly to the support element, a movable part of which carries a locking finger.
- the or each locking finger is capable of cooperating with an extended part of the base constituting the second region.
- the or each second actuator is capable of generating a linear force in a generally horizontal direction.
- the or each finger and its extended counterpart cooperate via inclined surfaces capable of converting said linear force into a force with a vertical component.

According to a second aspect, a wind propulsion unit for a vessel is proposed, said unit being elongate and capable of adopting an erect orientation, and comprising one or more propulsive elements and a mast, characterized in that a proximal region of the mast is rigidly connected to a base rotatably mounted about a generally horizontal main axis on a support element intended to be attached to a deck of the vessel, a tilt control device capable of causing the base to rotate relative to the support, which tilt control device comprises a first actuator capable of generating a linear force in a horizontal direction and a redirection element connecting said actuator to the base in order to exert a force on the base in a first region located at a distance from the main axis, and a locking device for locking the base to the support element, which locking device comprises a second actuator that is capable of exerting, in a second region of the base distant from the first region in a direction transverse to said main axis, a retaining force in the vertical direction, said wind propulsion unit, when installed on a vessel, being movable, by virtue of the one or more first actuators, between an inactive position, wherein it extends substantially parallel to the deck of the vessel and an active erect position, the locking device being capable of contributing to holding the unit in its active position.

According to a third aspect, a tilt mounting assembly is proposed for an elongate wind propulsion unit intended to adopt an erect orientation and comprising one or more propulsive elements and a mast, the assembly being characterized in that it comprises a base configured to receive a proximal region of the mast and rotatably mounted about a generally horizontal main axis on a support element intended to be fixed to a deck of a vessel, a tilt control device capable of causing the base to rotate relative to the support element, comprising at least a first actuator capable of generating a linear force in a generally horizontal direction when the assembly is in place, and a redirection element connecting said actuator to the base to exert a force on the base in a first region of the base located at a distance from said main axis, and a device for locking the base on the support element comprising at least one second actuator capable of exerting, in a second region of the base distant from the first region in a direction transverse to said main axis, a retaining force in a vertical direction when the assembly is in place.

BRIEF DESCRIPTION OF THE DRAWINGS

Other aspects, aims, and advantages of the present invention will become more apparent on reading the following detailed description of a preferred embodiment thereof, given by way of non-limiting example and made with reference to the accompanying drawings, wherein.

DETAILED DESCRIPTION OF A PREFERRED EMBODIMENT

We will now describe a tilt device for a wind propulsion unit, in this case a rigid mast-sail with two flaps, enabling such a propulsion unit to be selectively erected and lowered.

In its erect position, each propulsion unit is used to assist the vessel's motion, by adjusting the flap orientation as required.

In its lowered position, each wind propulsion unit typically extends parallel to the vessel's upper deck, longitudinally or even transversely or obliquely, so as not to impede loading/unloading maneuvers in the case of a merchant ship, or navigation maneuvers in the case of a passage under a deck.

Figure 1:
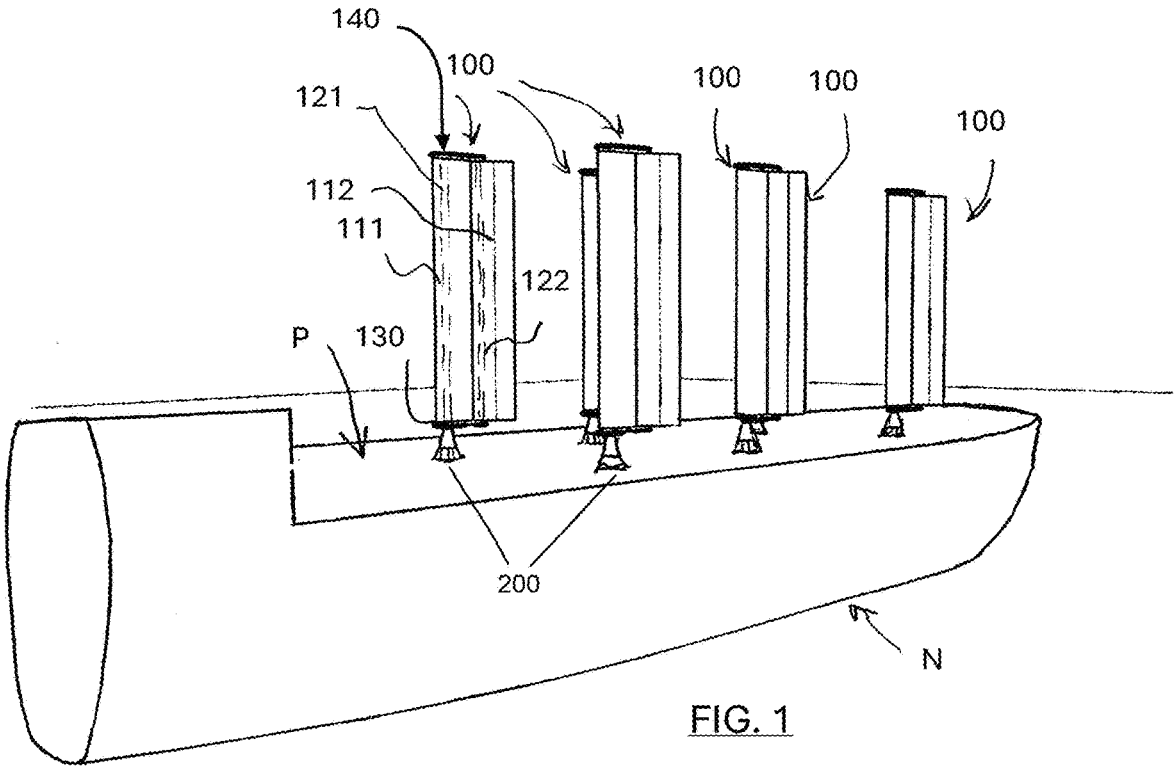
FIG. 1 is an overall perspective view of a vessel equipped with a series of mast-sail wind propulsion units.
Figure 2:
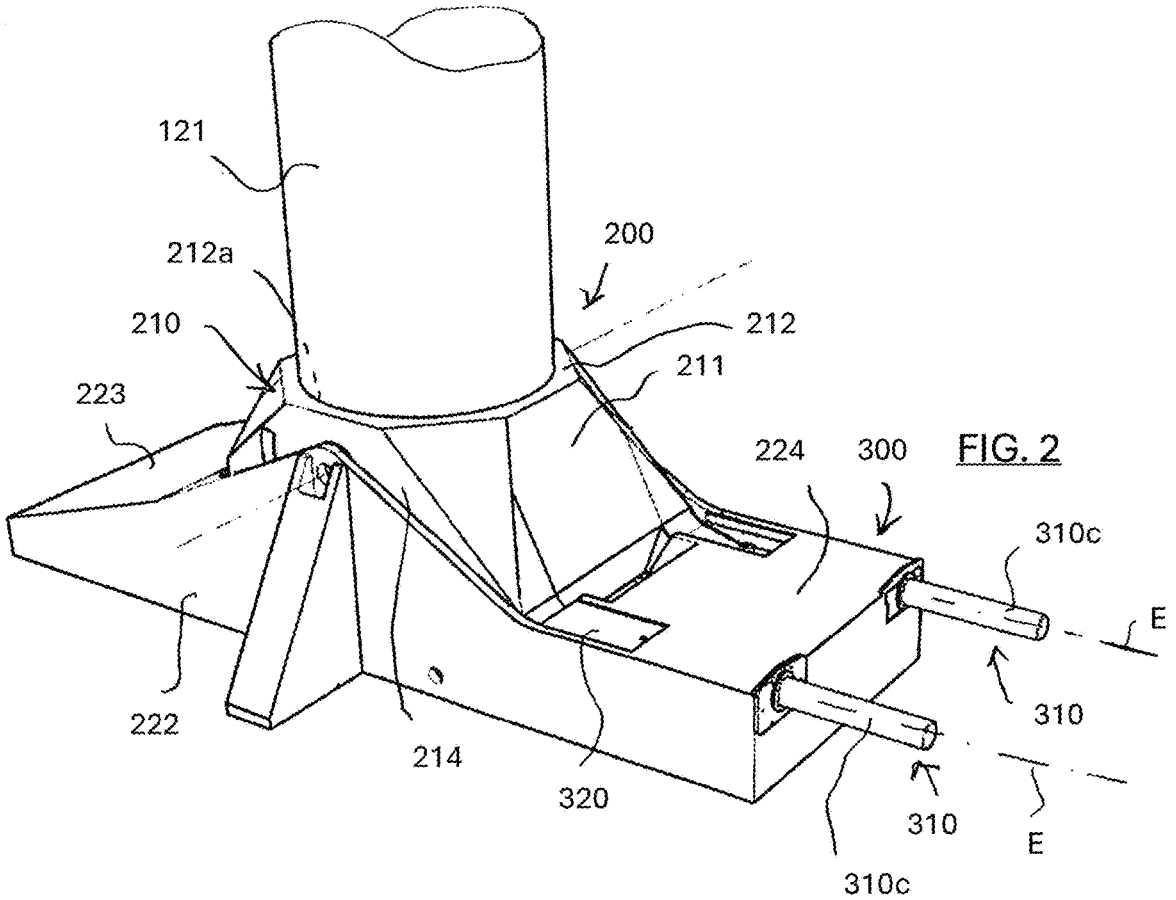
FIG. 2 is an overall perspective view of the base region of a wind propulsion unit in the erect position.
Figure 3:
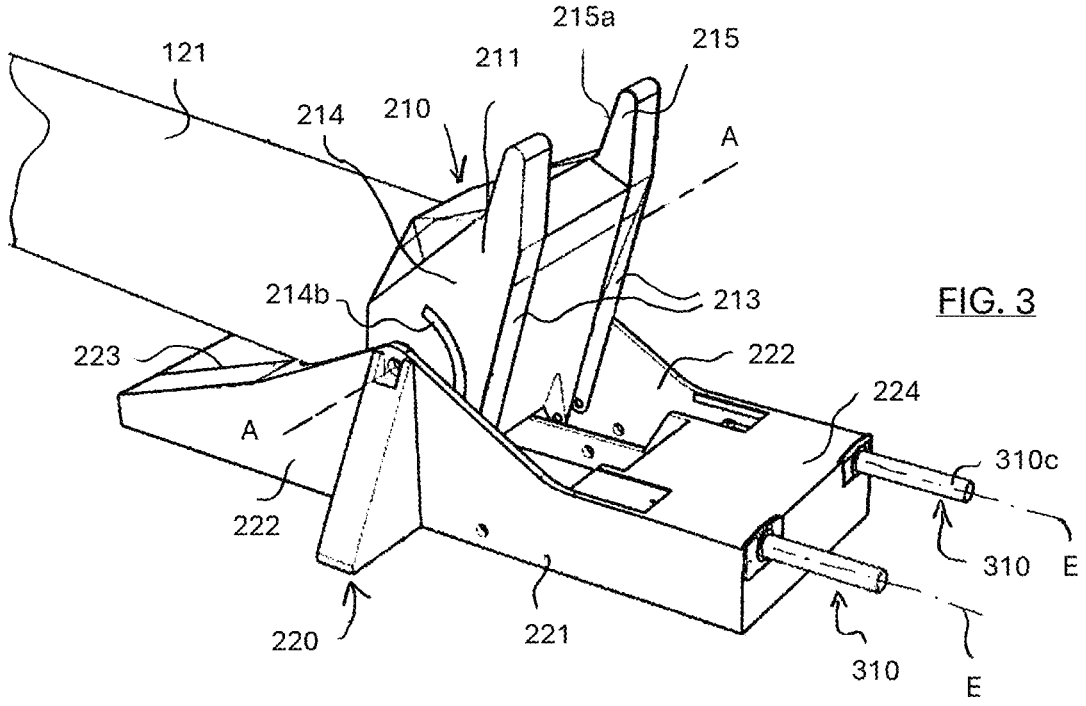
FIG. 3 is a perspective view of the base region of a wind propulsion unit in the lowered position.
Figure 4:
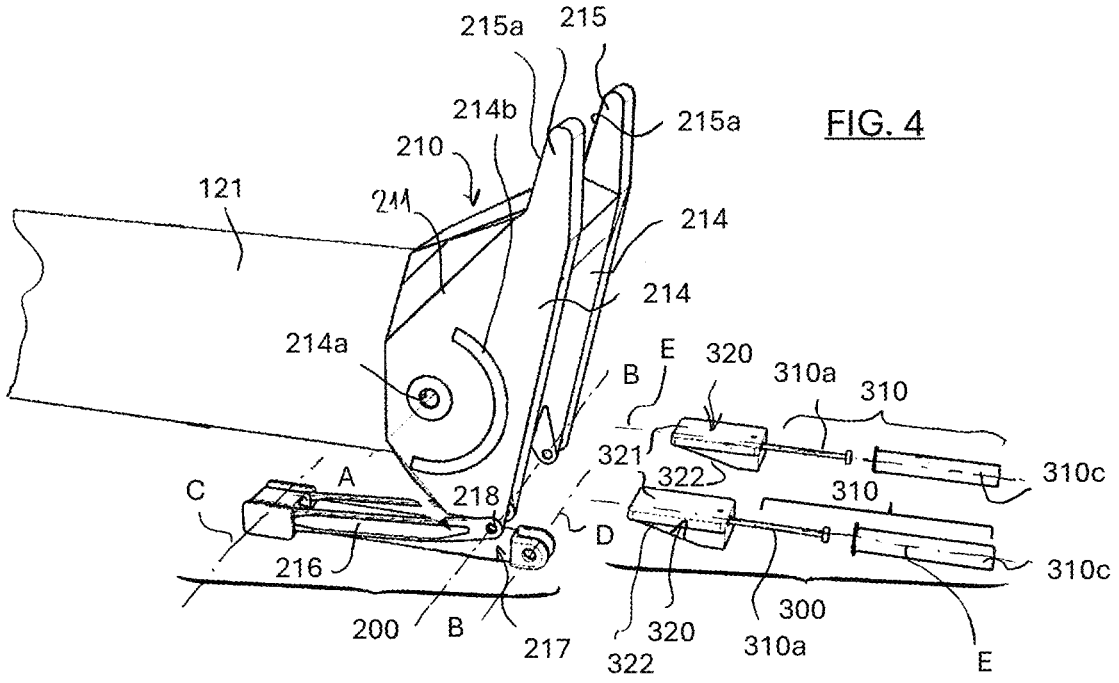
FIG. 4 is a partial view of the base region, in the same position as FIG. 3.

FIG. 1 illustrates a vessel N, for example an oil tanker or bulk carrier, on the deck P of which six tilt-rotor propulsion units 100 according to the invention are mounted, in two rows of three propulsion units each.

Each propulsion unit here comprises two flaps/propulsive elements 111, 112, the front flap being traversed by a main mast 121 and the rear flap being traversed by a secondary mast 122, the two masts being connected at the bottom and top by a boom element 130 and a gaff element 140.

The main mast 121 protrudes below the element 130 and forms the main support for the mast-sail. The mast-sail can be designed, for example, in accordance with the teachings of patent applications WO2018087649A1 and WO2020115717A1.

Referring now to FIGS. 2 to 6, the main mast 121 has a tilt device at its base, comprising a rotation mechanism 200 and a locking mechanism 300.

The rotation mechanism 200 comprises a mast base/tilting element 210 to which the base of the main mast 121 is rigidly attached.

This base 210 is formed by a main body 211 having in an upper face 212 a blind opening 212*a* for embedding the mast base 121.

The lower face 213 of the body 211 is generally flat and forms a bearing surface on a counterpart region of the vessel's deck when the wind propulsion unit is in the erect position. The structure of the body can be solid or formed of assembled elements, for example welded metal elements principally comprising two lateral framing elements rigidly connected together by transverse framing elements, as shown, the underside of the body then being wholly or partially constituted by the undersides of the lateral framing elements.

Here, the body 211 comprises two lateral framing parts 214, each of which has a through-hole 214*a* for a cylindrical shaft (not shown) defining a main horizontal axis of rotation A of the base 210, and an arcuate groove 214*b* centered on the axis A.

The base also comprises, in this case at the parts 214, two projecting extensions 215 extending generally horizontally in a direction perpendicular to the axis A, along the lower bearing surface 213 of the body, each extension having an inclined or beveled upper surface 215*a* such that its height decreases from its root towards its free end, said free end being rounded.

These extensions 215 are designed to cooperate with a locking mechanism 300 as described below.

On the side of the base 210 opposite the extensions 215, the body 211 has one or more holes 218 in the vicinity of its lower face, which together define an axis B parallel to the axis A. A secondary shaft (not shown) connects two linkages/tilt control device 216 (connected respectively to the body's lateral framing elements) to the body 211, allowing them to pivot about said axis B.

At their opposite end, at a distance from the base 210, these linkages 216 are connected in an articulated manner around an axis C parallel to the axes A and B, to two hydraulic cylinders/first actuator 217.

Each cylinder 217 comprises a cylinder rod 217*a* carrying a head 217*b* by which the cylinder is articulated to a respective linkage along the C axis, and a cylinder body 217*c* whose end opposite the rod 217*a* is articulated, along an axis D parallel to the axes A, B and C, to a fixed support frame/support element 220 rigidly attached by any suitable means, such as welding or bolting, to the vessel's deck.

This support frame 220 essentially comprises a framework 221 with, in particular, two reinforced side walls 222, a first top wall 223 located on the side of the linkage/cylinder assemblies 216, 217 and a second top wall 224 located above the locking mechanism 300. Not shown, the two side walls 222 of the support frame 220 each comprise an inwardly pointing finger engaged in the respective arcuate groove 214*b*.

The support frame 220 also comprises means for linearly guiding the movement of the cylinder head 217*b*, not shown.

The combination of a main shaft running along axis A and the two assemblies of a finger and an arcuate groove makes for a particularly robust pivot with a limited footprint. The circular grooves 214*b* also act as angular end-of-travel stops for moving the mast to its erect position and, if required, to its lowered position.

The base 210 and the support frame 220 are sized to ensure the transfer of forces, i.e., on the one hand the forces caused by the wind propulsion unit lifting and lowering operations as described below, and on the other hand the forces generated by the wind on the propulsion unit during navigation and transferred to the vessel.

The locking mechanism 300 here comprises two hydraulic cylinders/second actuator 310 oriented horizontally and generally parallel to the cylinders 217, and therefore transversely to the axes A, B, C and D.

Each cylinder 310 comprises a cylinder body 310*c* rigidly mounted on the support frame 220, outside the latter, and a cylinder rod 310*a* which carries at its free end a locking finger 320 having a generally horizontal upper face 321 and a beveled lower face 322, so that the thickness of the finger decreases in the direction of the base 210.

The support frame 220, and in particular its upper wall 224 in cooperation with other parts not shown, guides each finger 320 along a respective linear displacement axis E, which here is generally horizontal and perpendicular to axes A, B, C and D.

Each finger 320 is designed to cooperate with a respective extension 215 of the base in the erect position of the wind propulsion unit, its lower beveled surface 322 bearing on the upper beveled surface 215*a* of the respective extension so as to exert, when the cylinder is actuated, a force whose downward component tends to stabilize the base 210 against the frame 220 in this erect position.

The device of the present invention operates as follows.

With the wind propulsion unit lowered and resting on the vessel's deck (position shown in FIGS. 3 and 4), the two cylinders 217 are thrust-actuated to exert a moment about the axis A on the base 210 via the linkages 216, causing the propulsion unit to gradually rise.

It should be noted that the forces required for this movement are directed essentially in the plane of the vessel's deck, thus avoiding imposing significant vertical forces on the deck, which might require reinforcement of the deck structure.

The forces required for lifting can be supplemented by any other appropriate force generation.

The continuation of this movement brings the propulsion unit and its mast 121 into an erect position, generally vertical.

During the aforementioned lifting movement, the cylinders 310 of the locking device 300 are in the retracted position (fingers 320 to the right in the Figures) so as to allow the base 210 to reach its stable position, resting against the frame 220.

Figure 5:
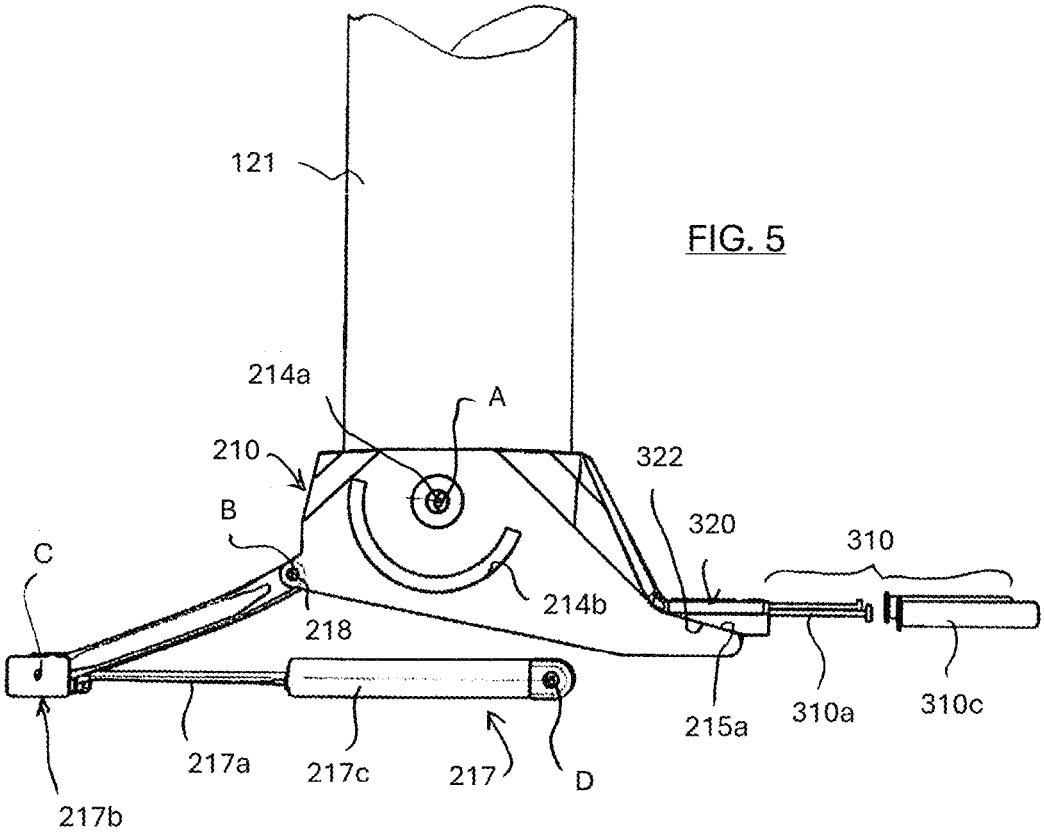
FIG. 5 is a side elevation view of the base region of a wind propulsion unit in the erect position.
Figure 6:
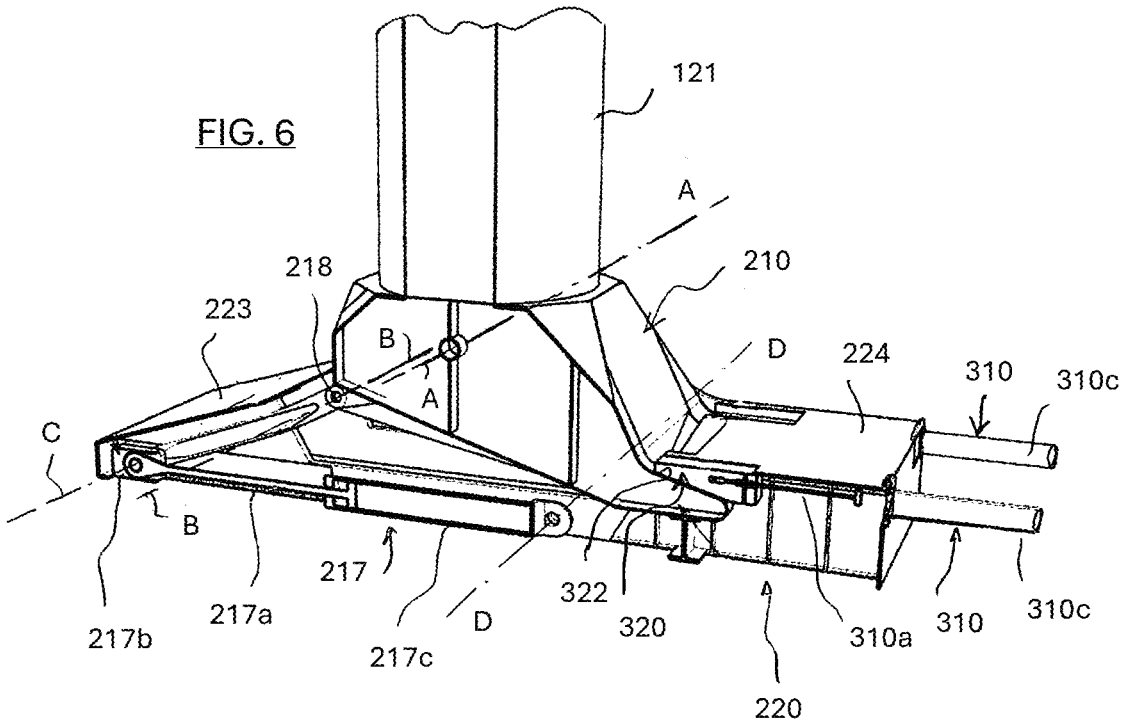
FIG. 6 is a perspective view, with vanishing point and cutaway, of the base region of the wind propulsion unit in erect position.

Once this position has been reached, the actuators 310 are deployed to move the fingers 320 to the left and enable them to lock the base 210 in this position, by bearing on the upper surfaces 215*a* of its extensions 215, as shown in FIGS. 5 and 6. With the cylinders 217 locked in their deployed position on the opposite side, they hold the mast 212 in position on that opposite side via the linkages 216.

To bring the wind propulsion unit from its erect position to its lowered position, the reverse movements are performed.

The device of the present invention has many advantages:

- firstly, it is compact in both its horizontal and vertical dimensions, taking up limited space on the vessel's deck and leaving, for a given total height of the propulsion unit, plenty of room for the propulsion unit itself;
- then, thanks to the redirection by the linkages 216, the cylinders 217 can have a reasonably short stroke;
- in addition, the tilt device can be pre-assembled and pre-calibrated before being mounted on the vessel, thus reducing installation costs and increasing reliability;
- as indicated, the essentially horizontal direction of the forces means that the deck does not have to bear any significant forces, such as vertical forces, which could require structural reinforcement.

Of course, the present invention is by no means limited to the embodiments described above and shown in the drawings; rather, the person skilled in the art will know how to make numerous variants or modifications.

In particular, the orientations of the various axes and the directions of movement of the cylinders may differ from those described, as the person skilled in the art understands that variations are possible. In particular, the working directions of the cylinders can be oblique.

Alternatively, the locking mechanism can take any form other than that shown, in particular by providing fingers penetrating into holes in the base.

Last but not least, the propeller can be any propeller, such as a Magnus rotor, a suction rotor, a rigid wing, etc.

The invention claimed is:

1. A vessel comprising at least one wind propulsion unit that is elongate in a vertical direction when in an operating position comprising propulsive elements and a mast, and further comprising, in combination with at least one wind propulsion unit, a tilting device comprising a base that is rigidly attached to a proximal region of the mast, which tilting device rotates on a generally horizontal main axis on a support element attached to a deck of the vessel, a tilt control device capable of causing said base to rotate relative to said support element, which tilt control device comprises at least one first actuator capable of generating a linear force in a horizontal direction and a redirection element connecting said actuator to said base in order to exert a force on the base in a first region thereof located at a distance from said generally horizontal main axis, and a locking device for locking said base to said support element, which locking device comprises at least one second actuator that is capable of exerting, in a second region of the base distant from the first region in a direction transverse to said generally horizontal main axis, a retaining force in said vertical direction, said at least one wind propulsion unit being movable, by virtue of said one or more first actuators, between an inactive position, wherein said at least one wind propulsion unit extends along the deck of the vessel and an active erect position, the locking device being capable of contributing to holding said at least one wind propulsion unit in the active erect position thereof.

2. The vessel according to claim 1, wherein the or each said first actuator is oriented generally horizontally and is connected to said first region by a respective linkage articulated on a movable part of the actuator and on said first region of the base along two axes generally parallel to said generally horizontal main axis.

3. The vessel according to claim 1, comprising two first actuators and two redirection elements connected to said base at two first regions thereof generally aligned in a direction parallel to said generally horizontal main axis.

4. The vessel according to claim 3, wherein the rotary mounting of the base on said support element comprises a rotary shaft having an axis that coincides with said generally horizontal main axis, and at least one arcuate groove having a center located on said generally horizontal main axis, cooperating with a finger capable of moving in said groove during rotation.

5. The vessel according to claim 1, wherein the or each second actuator comprises a cylinder fixed rigidly to the support element, a movable part of which carries at least one locking finger.

6. The vessel according to claim 5, wherein the or each said locking finger is capable of cooperating with an extended part of the base constituting the second region.

7. The vessel according to claim 6, wherein the or each second actuator is capable of generating a linear force in a generally horizontal direction.

8. The vessel according to claim 7, wherein the or each finger and said extended part of the base cooperate via inclined surfaces capable of converting said linear force into a force with a vertical component.

9. A wind propulsion unit for a vessel, said unit being elongate and capable of adopting an erect orientation, and comprising one or more propulsive elements and a mast, wherein a proximal region of the mast is rigidly connected to a base rotatably mounted about a generally horizontal main axis on a support element configured for attachment to a deck of the vessel, a tilt control device capable of causing the base to rotate relative to the support element, which tilt control device comprises at least one first actuator capable of generating a linear force in a horizontal direction and a redirection element connecting said actuator to the base in order to exert a force on the base in a first region of the base located at a distance from said generally horizontal main axis, and a locking device for locking the base to the support element, which locking device comprises at least one second actuator that is capable of exerting, in a second region of said base distant from said first region of said base in a direction transverse to said generally horizontal main axis, a retaining force in a vertical direction, said wind propulsion unit, when installed on a vessel, being movable, by virtue of said one or more first actuators, between an inactive position, wherein said wind propulsion unit extends substantially parallel to the deck of the vessel and an active erect position, the locking device being capable of contributing to holding said wind propulsion unit in said active erect position thereof.

10. A tilt mounting assembly for an elongate wind propulsion unit intended to adopt an erect orientation and comprising one or more propulsive elements and a mast, said assembly comprising a base configured to receive a proximal region of the mast and rotatably mounted about a generally horizontal main axis on a support element configured for securement to a deck of a vessel, a tilt control device capable of causing the base to rotate relative to the support element, comprising at least one first actuator capable of generating a linear force in a generally horizontal direction when said assembly is in place, and a redirection element connecting said actuator to the base to exert a force on the base in a first region of the base located at a distance from said generally horizontal main axis, and a locking device for locking the base on the support element comprising at least one second actuator capable of exerting, in a second region of the base distant from said first region of the base in a direction transverse to said generally horizontal main axis, a retaining force in a vertical direction when said assembly is in place.

* * * * *